United States Patent [19]

Romberg

[11] Patent Number: 4,566,223

[45] Date of Patent: Jan. 28, 1986

[54] PEDAL ACTUATED GATE

[76] Inventor: Felix B. Romberg, P.O. Box 218, Holland, Tex. 76534

[21] Appl. No.: 607,772

[22] Filed: May 7, 1984

[51] Int. Cl.[4] ..... E05F 13/00

[52] U.S. Cl. ..... 49/264; 49/272; 49/282

[58] Field of Search ..... 49/264, 272, 282, 293, 49/294

[56] References Cited

U.S. PATENT DOCUMENTS

| | | | |
|---|---|---|---|
| 308,752 | 12/1884 | Cook | 49/272 X |
| 1,152,999 | 9/1915 | Williamson | 49/272 X |
| 1,717,473 | 6/1929 | Stewart | 49/282 X |
| 2,393,418 | 1/1946 | Sawyer | 49/272 X |

*Primary Examiner*—Philip C. Kannan

*Attorney, Agent, or Firm*—Richards, Harris, Medlock & Andrews

[57] ABSTRACT

A pedal actuated laterally swinging gate comprises the gate, a wheel-engaged pedal mechanism at each side of the closed gate for causing the gate to open in the direction away from an approaching vehicle, and a fence-like board barrier to guide vehicles to the pedals, to protect the pedal mechanisms from livestock and to support the unit which flings the gate open, leaving the gate easy to open manually and permitting the gate to be an easily swung structure.

5 Claims, 13 Drawing Figures

FIG. 11
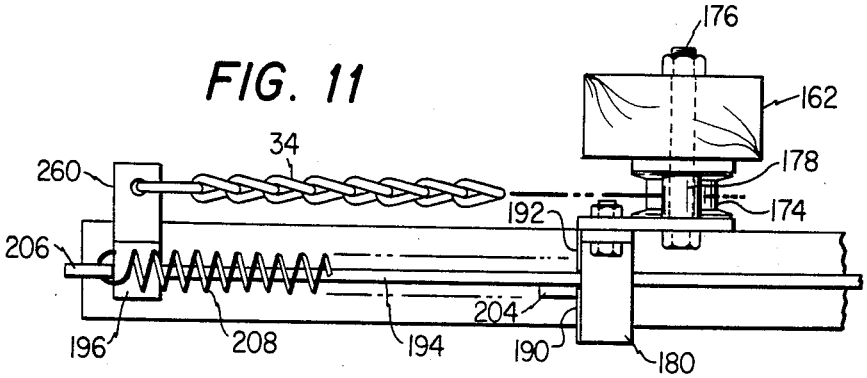
FIG. 12
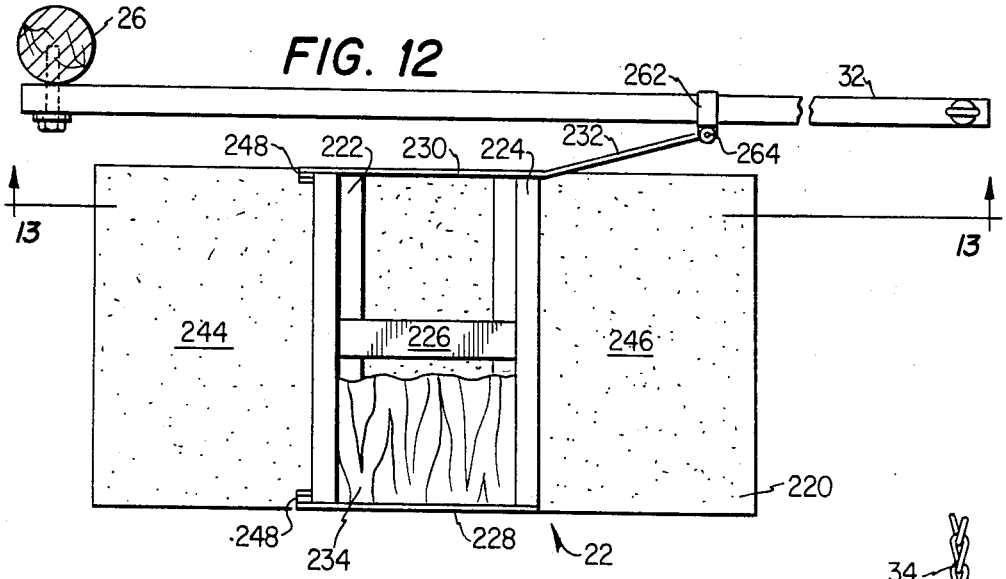
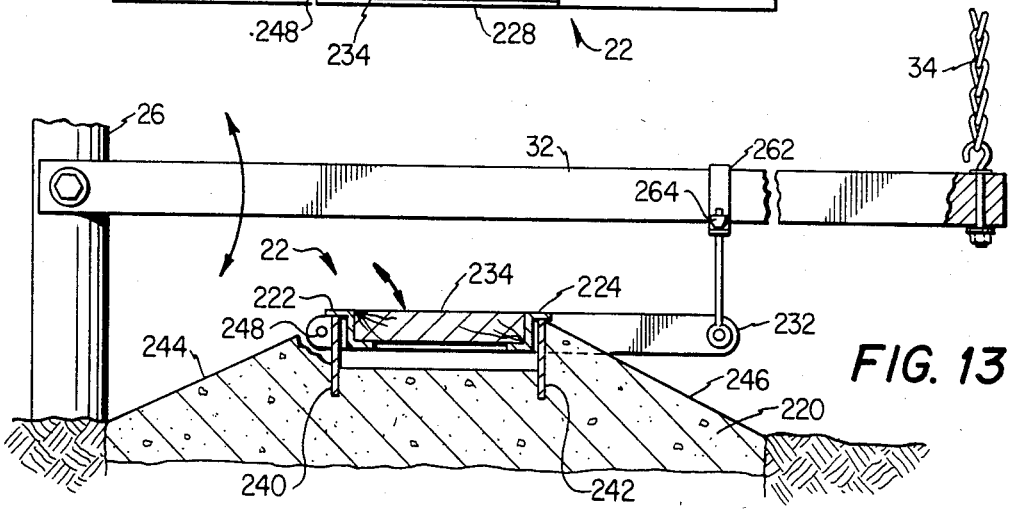
FIG. 13

PEDAL ACTUATED GATE

BACKGROUND ART

Early automobiles had front bumpers that were deeply resilient and extended well in front of the vehicle body. Such bumpers were adapted for pushing gates open. Later automobiles have had bumpers close to the body shell, which together with variations in bumper styles prevents opening conventional gates with direct vehicle thrust.

Electric motor driven gates that the driver can control from his cab are now available, but each vehicle must carry a controller, and electricity must be available or provided by a battery. In connection with electric fencing, electrified arms and other reduced structures can be used as push-through gates. Such gates are respected by livestock, are virtually unaffected by wind and yield readily to vehicles. However, electrified fences and gates can injure humans and are thus limited in their application.

Livestock also respects barbed wire. A distinction needs to be made between stockyard gates in which strength is the dominant consideration and gates for outfences and driveways, such as the present invention, where animals are not closely confined and escape when the gate is left standing open, rather than through structural failure of the gate.

SUMMARY OF THE INVENTION

A simple gate is swung open in both directions from the same closed position by a mechanism including a main spring. The main spring is charged by a pedal mechanism on each side of the closed gate to fling the gate open in the direction away from the vehicle as its front wheel crosses the pedal.

DESCRIPTION OF THE DRAWINGS

A better understanding of the invention can be had by reference to the following detailed description in conjunction with the accompanying drawings, in which:

FIG. 11 is a partially broken away overhead view of an end portion of the unit of FIG. 3;

FIG. 12 is a partially broken away overhead view of a pedal; and

FIG. 13 is a sectional view taken along line 13—13 of FIG. 12.

DETAILED DESCRIPTION

Figure 1:
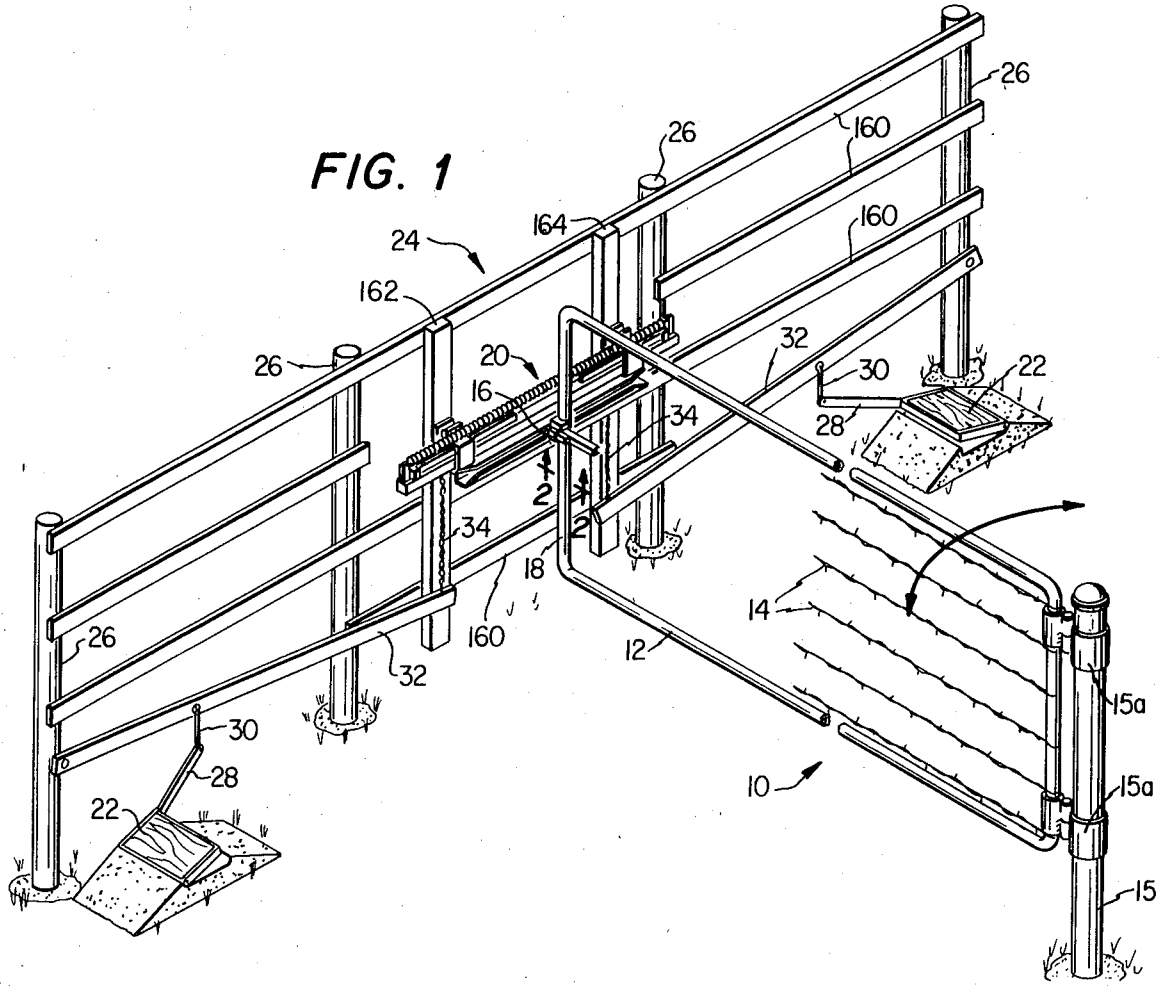
FIG. 1 is a perspective view of the pedal actuated gate of the present invention.

Referring initially to FIG. 1, this invention includes a gate 10 with a rectangular tubular frame 12 supporting a wire barrier 14 and hingedly connected to post 15 by means of hinges 15*a*. A latch pin assembly 16 is mounted midway along the vertical frame member 18 at the openable end of gate 10. A unit 20 is provided to normally hold the gate 10 closed and fling it open when one of pedals 22 is depressed by a vehicle. Unit 20 is supported by a board barrier 24 mounted on posts 26. Pedals 22 are connected to unit 20 by means of a linkage consisting of arms 28, rods 30, levers 32 and chains 34.

Figure 2:
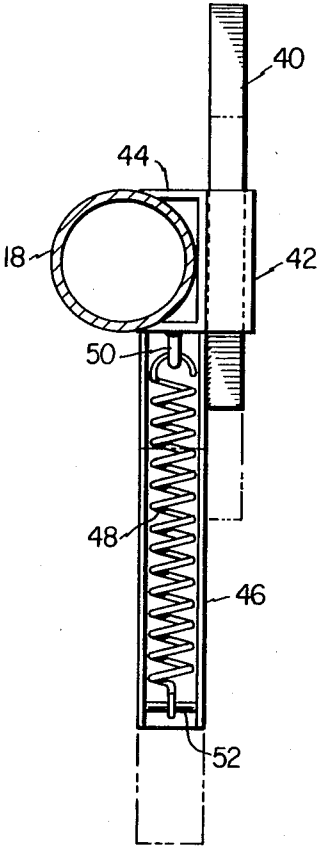
FIG. 2 is a partial sectional view of a latch pin assembly taken along line 2—2 of FIG. 1.

Referring now to FIG. 2, the latch pin assembly 16 includes a latch pin 40 that is preferably rectangular in cross section with the vertical dimension of the cross section being twice as great as the horizontal dimension. The latch pin 40 is longitudinally slidable in a guideway 42 between the positions shown in dotted and solid lines in FIG. 2. Guideway 42 is attached to vertical frame member 18 by means of base 44. Handle 46 is integrally attached to latch pin 40 and is a hollow structure enclosing tension spring 48. One end of this spring 48 is hooked to a loop 50 projecting from the side of the base 44. The outer end of this spring 48 is hooked to a cross bar 52 at the outer end of the handle 46. Handle 46 thus encloses the spring 48 on three sides and is open at the bottom. In operation, the spring 48 normally holds the handle 46 against the base 44, keeping the latch pin 40 in position to project beyond the vertical frame member 18 of the gate frame 12. To open the gate manually, the handle 46 is pulled against the tension of spring 48 to the position indicated by the dotted lines, otherwise the spring 48 keeps the latch pin 40 extended.

Figure 3:
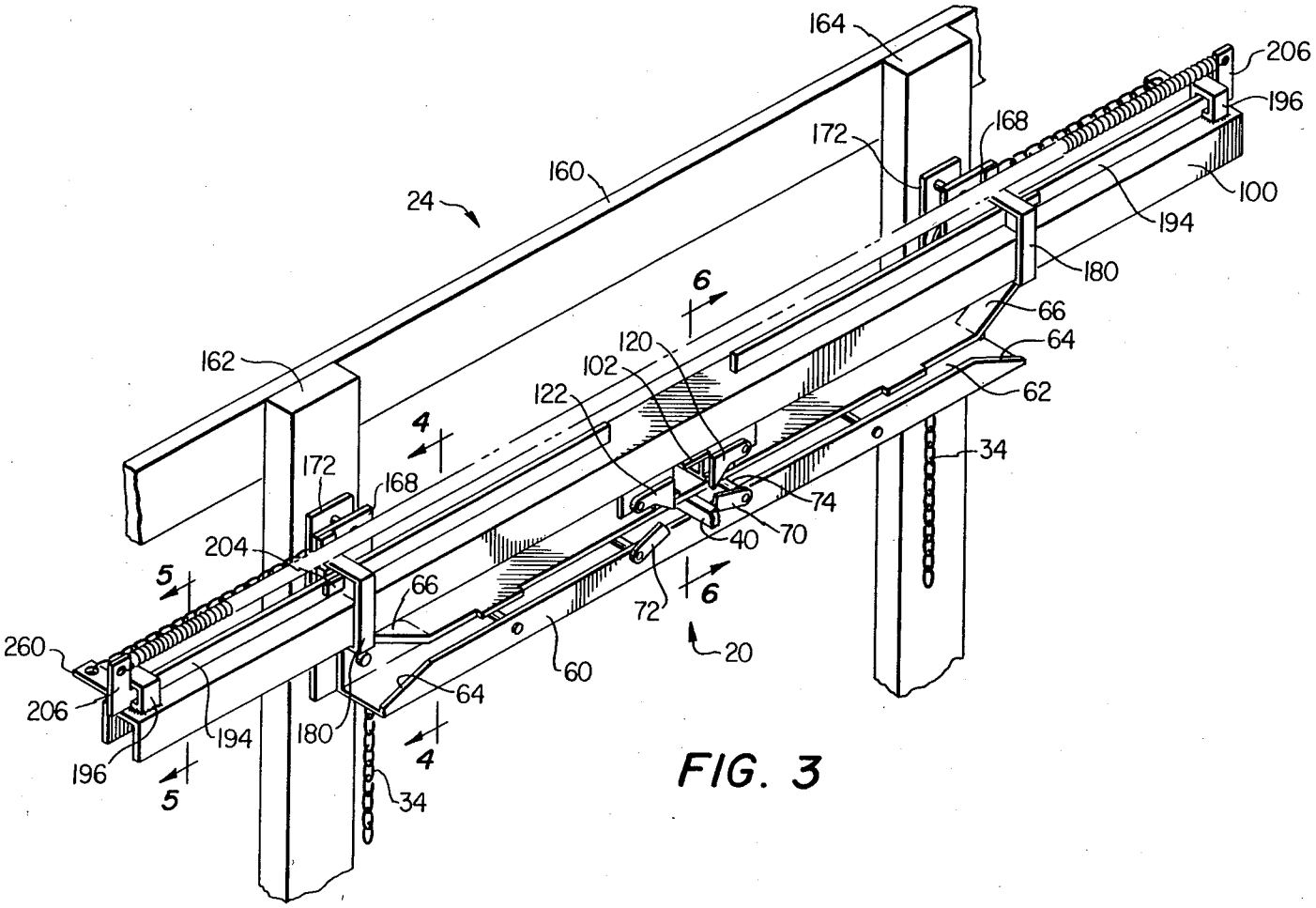
FIG. 3 a perspective view of a unit for holding the gate closed and flinging the gate open, shown in its normal condition for holding the gate closed and with the latch pin partially broken away.

Referring now to FIG. 3, tangential to the swing path of the openable end of the gate 10 is a unit 20 which holds the gate closed and flings it to open positions in both directions. The unit 20 is identical on each end, with the corresponding parts on each end reversed. Portions of the discussion below are directed to only one end of unit 20, but it will be understood that said discussion is applicable to either end of the device.

Figure 4:
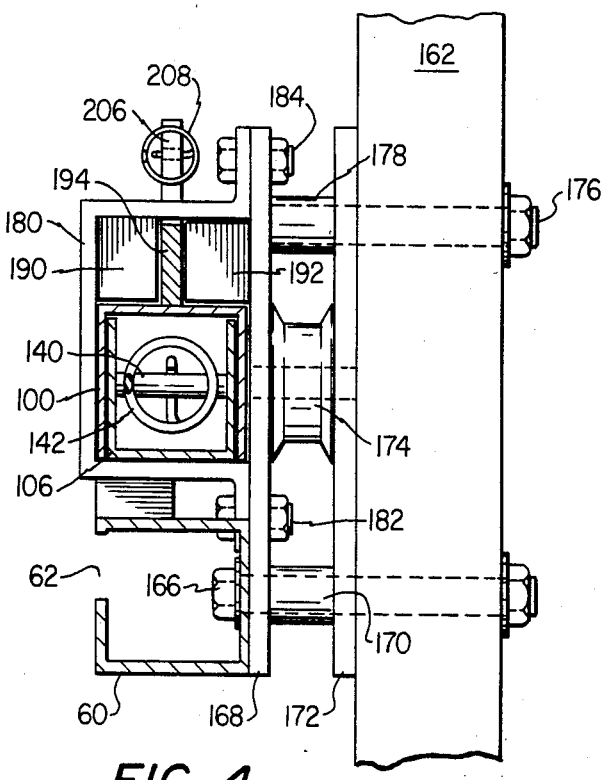
FIG. 4 is a sectional view taken along line 4—4 of FIG. 3.
Figure 6:
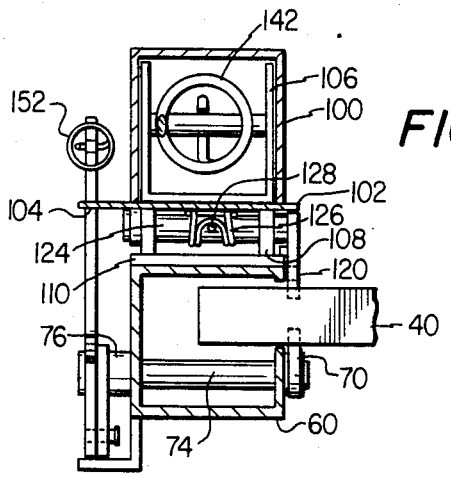
FIG. 6 is a sectional view taken along line 6—6 of FIG. 3.

As shown in FIGS. 3, 4 and 6, a fixed longitudinal member 60 of unit 20 is formed of square tubing, except that it has in the upper half of its side facing the closed gate a slot 62 along its entire length. Slot 62 receives the projecting end portion of the latch pin 40. As shown in FIG. 3, the slot 62 is windened outwardly at each end by cutting into the lower side a slant edge 64 and by bending the wall 66 above the slot. The purpose of the widened entrance to the slot 62 is to direct the latch pin 40 into the slot as the gate swings to its closed position. On account of the curvelinear swinging movement of the latch pin 40, it will not project as deep into the slot 62 at the entrance of the slot as at the closed position. Hence, in forming wall 66, it is not necessary to bend up more than half of the end portion of the top of member 60. The top of member 60 is split longitudinally along the center to form wall 66.

Referring now to FIGS. 3, 6, 7 and 8, at the gate's closed position the latch pin 40 is confined between a pair of lower detents 70 and 72. The detent 70 is attached to shaft 74 which extends through perforations in member 60 to a collar 76. Collar 76 is secured to the shaft 74 and has an arm 78 with a forked end 80 which normally rests on a shelf 82.

Figure 7:
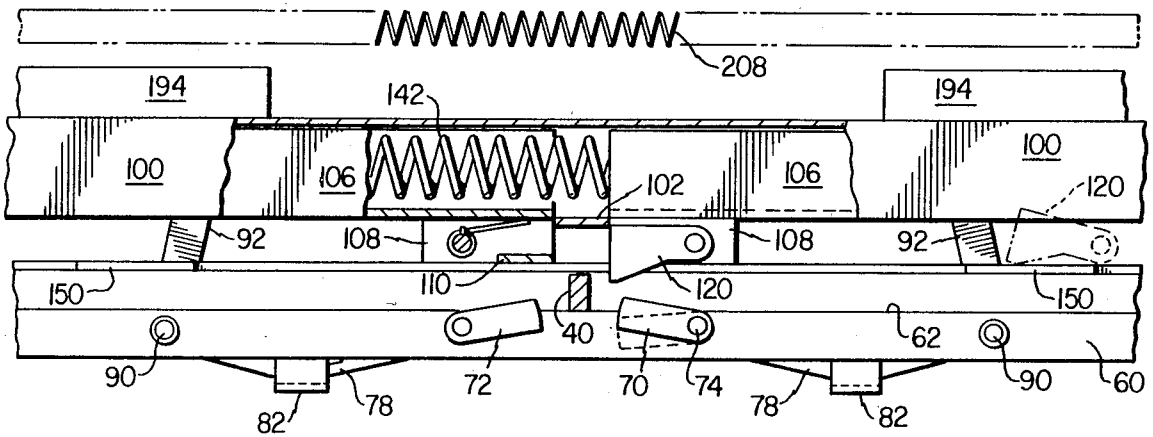
FIG. 7 is a partially broken away front view of the unit of FIG. 3.
Figure 8:
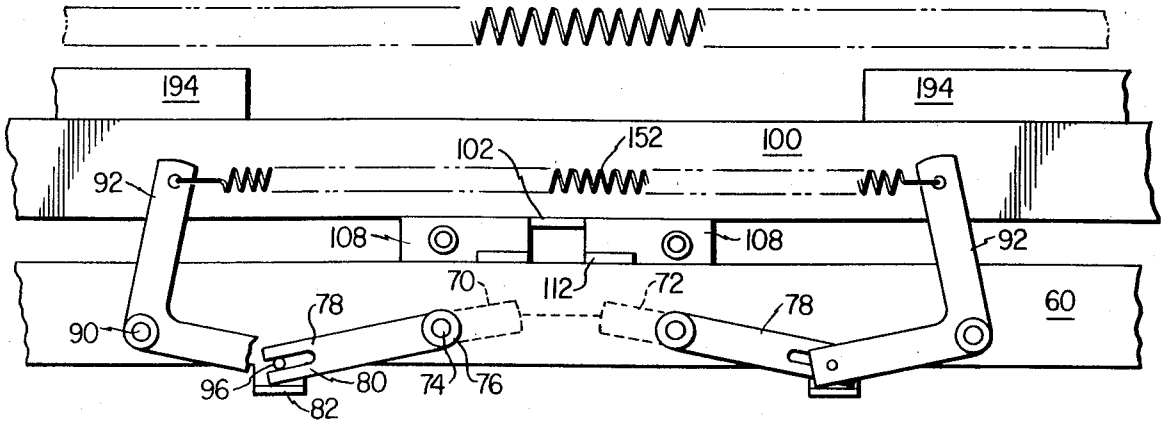
FIG. 8 is a partial back view of the unit of FIG. 3.

As shown in FIGS. 7 and 8, shaft 90 is mounted through perforations in member 60. Shaft 90 is attached to two arms, an upright arm 92 and an arm 94 which is intermeshed with the forked end 80 of arm 78 by means of a perpendicularly extending pin 96 meshed between the forks and terminating with an expanded head to retain the forked end. The other lower detent 72 is associated with a series of parts similar to those shown in FIGS. 6, 7 and 8 but extending in the opposite direction. Detents 70 and 72 are mounted on the fixed member 60 in position to contact the lower part of the latch pin 40.

Referring now to FIGS. 3, 4, 5, 6, 7 and 8, spaced above the slotted fixed longitudinal member 60 is a longitudinally slidable longitudinal member 100 which in cross section is channel that is open at the bottom except for a single bridge member 102. Bridge member 102 is a plate welded across the bottom of member 100 to bridge the space between the two sides and includes extension 104 (FIG. 6). As shown in FIGS. 4, 5, 6, 7 and 9, on each side of the bridge member 102, inside the member 100, an inner shell 106 is longitudinally slidable. At the end of each shell 106 facing the bridge 102 and extending downward along both sides of the shell 106 are skids 108. Inset in the skids 108, so as to be aligned with the bottom of the skids, at the end of the shell 106, is a plate 110 extending between the skids and providing a shoulder 112 beyond each of the skids 108.

Figures 9, 10:
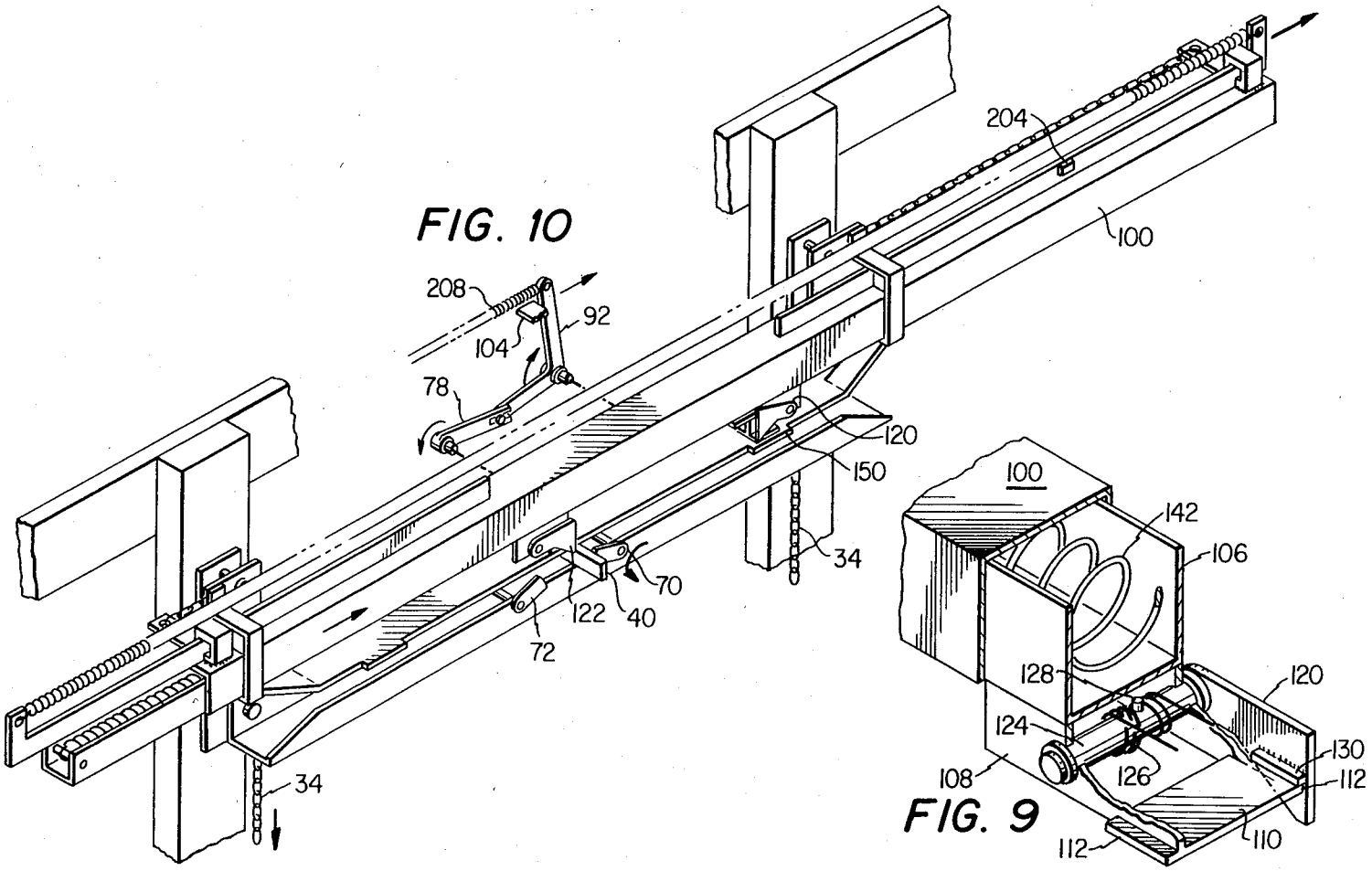
FIG. 9 is a partially broken away perspective view of the unit of FIG. 3.
FIG. 10 is a partially broken away perspective view of the unit of FIG. 3, shown in position to fling the gate open.

As shown in FIGS. 3 and 7, detents 120 and 122 extend downward from shell 106 to make contact with the upper part of the latch pin 40. As shown in FIGS. 6 and 9, the detent 120 is attached to shaft 124 which is mounted in perforations through the skids 108. A loop in the middle of a wire spring 126 is held by a pin 128 in the shaft 124 to urge the detent downward. A block 130 (FIG. 9) projects inward along about the middle of the depth of the detent 120. The block 130 is normally seated upon the shoulder 112 of plate 110 by the torque exerted by the wire spring 126, the ends of which are against the bottom of the shell 106.

As best shown in FIGS. 6 and 7, the skids 108 rest on the fixed longitudinal member 60. These skids 108 and the shafts 124 of the detents 120 and 122 occupy vertical space between the longitudinal members 60 and 100. Except for detents 120 and 122, the two inner shells 106 may be identical structurally. Inner shells 106 are mounted with their skid-bearing ends towards the bridge member 102. Inner shells 106 are open at the top and are inside the member 100 which is open at the bottom.

Figure 5:
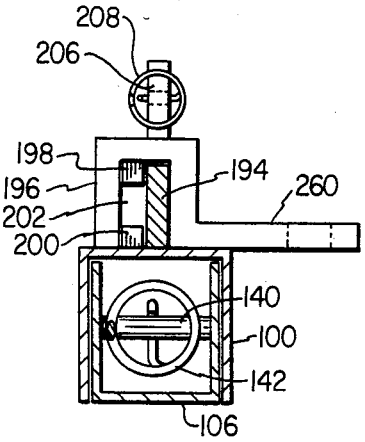
FIG. 5 is a sectional view taken along line 5—5 of FIG. 3.

As shown in FIGS. 4 and 5, integral with each inner shell 106 at its distal end is a horizontal cross member 140 located intermediate of the vertical walls of inner shell 106. As shown in FIGS. 4, 5, 6 and 7, hooked to cross members 140 in tension and passing above the bridge member 102 is a helical main spring 142 which normally forces both inner shells 106 at their skids 108 against the bridge member 102. This places the detents 120 and 122 normally in the positions shown in FIG. 3, while shoulders 112 maintain the ends of the detents in a vertical position.

In operation, when the slidable longitudinal member 100 shown in FIG. 3 is moved toward the right, as shown in FIG. 10, both upper detents 120 and 122 move in unison with member 100 until the latch pin 40 has been forced against the lower detent 70. Further movement of the slidable member 100 to the right causes bridge member 102 to continue to push the right inner shell 106 to the right and thereby continue to move detent 120 whereupon that detent will engage a rail 150 (FIGS. 7 and 10). The detent 120 will then become uplifted and ride on top of rail 150, as shown in FIG. 10 and in the dotted lines of FIG. 7, clearing the slot 62. In the meantime, the detent 122 has been constrained by the latch pin 40 as shown in FIG. 10. The constraint of detent 122 also constrains the attached left inner shell 106 while the right inner shell 106 is advanced in front of the bridge member 102 of the member 100, thereby elongating the main spring 142. As bridge member 102 is advanced, eventually the extension 104 contacts the upright arm 92 (FIG. 10) and pivots it backward thereby causing the lower detent 70 to move to the dotted position shown in FIG. 7. The movement of the lower detent 70 releases the latch pin 40 so that the stalled detent 122 in response to the tension of the main spring 142 pushes the latch pin 40 along slot 62 with rapid acceleration until the involved inner shell 106 comes to rest against the bridge member 102. By that thrust, the gate 10 is given sufficient velocity to be flung to its open position in that direction. Similarly, when the longitudinal member 100 is moved towards the left, the detent 122 will become uplifted, and bridge member 102 will engage the upright arm 92 causing the gate 10 to be opened in that direction. As shown in FIGS. 8 and 10, the two upright arms 92 are connected by a tension spring 152 which normally keeps detents 70 and 72 in the positions shown in FIGS. 3 and 7.

As shown in FIGS. 1, 3 and 4, the gate installation includes a fence-like board barrier 24 comprised of four posts 26 and boards 160. Between the two inner posts are vertically secured identical wooden standards 162 and 164 on which the unit 20 is mounted. As shown in FIGS. 3 and 4, a bolt 166 is passed successively through a perforation in the slotted member 60, a perforation in a wide plate 168, a spacer 170, a perforation in a narrow plate 172 and through the standard 162. Referring now to FIGS. 4 and 11, a pulley 174 is mounted on a shaft which extends into a perforation in the wide plate 168 and a perforation in the narrow plate 172. A bolt 176 passes through a perforation in the wide plate 168, through a spacer 178, through a perforation in the narrow plate 172 and through the standard 162. The bolts 166 and 176 are secured by washers and nuts outside of the standard 162, as shown in FIG. 4.

As shown in FIGS. 3 and 4, the slotted member 60 is terminated to provide space on the wide plate 168 for the bracket 180 which encloses member 100. The bolt 182 is passed through a perforation in the bracket 180 and through a perforation in the wide plate 168, and a nut applied as shown in FIG. 4. Another bolt 184 is passed through the opening in the bracket 180, through a perforation in the wide plate 168 and secured by a nut. Both the member 100 and the inner shells 106 are longitudinally slidable on the brackets 180.

Referring now to FIGS. 4 and 11, welded to the outer side of the upper corner of the bracket 180 is a plate 190. A similar plate 192 is welded to the outer side of the wide plate 168. The plates 190 and 192 confine the member 100 vertically and also define a vertically elongated space between them which is occupied by a flat bar 194 of rectangular cross section. Bar 194 is slidable on the longitudinal member 100 and extends through a guide box 196 which is integral with member 100 near the end of that member. This guide box has top and bottom interior blocks 198 and 200 (FIG. 5) on one side which retain the bar 194 in the vertical position while providing space 202 between them through which a block 204 (FIG. 3) secured to the side of the bar 194 may pass. The bar 194 has at its outer end an upstanding projection 206 which is perforated to receive one end of a tension spring 208 which extends to a similar projection on the similar bar mounted at the opposite end of the longitudinal member 100.

In operation, the blocks 204 on the bars 194 are immediately outside the plates 190 when the longitudinal member 100 is in its normal centered position. Hence, when the longitudinal member 100 is shifted in either direction from that centered position the tension of spring 208 bears against member 100 only at the extended end, for the tension of spring 208 at its other end is transmitted against the plate 190 by the block 204 instead of against member 100. By this means, the spring 208 returns the longitudinal member 100, and parts moving with it, from shifted positions to their normal positions.

As shown in FIGS. 1, 12 and 13, a pedal 22 engageable by a front motor vehicle wheel is disposed on each side of the gate's closed position. The fence-like board barrier 24 protects the pedals from livestock and guides vehicle drivers to the pedals. Because the front wheel is close to the outside of the front fender, wheel passage over the pedal is ensured by keeping the fender within a certain distance from the barrier. The pedal 22 is mounted at an elevated position on a concrete base 220. The object of the elevation is to insure very slow driving, to prevent fouling from dirt carried on tires and from ice and snow, and to keep animals from stepping on the pedal.

Referring now to FIGS. 12 and 13, the pedal 22 is constructed with two Z-bars 222 and 224 which are rigidly connected in the middle by a torque tube 226 to prevent the pedal from twisting. At their ends away from the board barrier 24, the Z-bars are connected by a plate 228. At their ends closest to the board barrier 24, the Z-bars are connected by a plate 230. Plate 230 is extended beyond the pedal as an arm 232. The two plates are rigidly welded to the Z-bars. The lower flanges of the Z-bars 222 and 224 extend towards each other and support wooden blocks 234, one on each side of the torque tube 226, which complete the pedal assembly. The pedal 22 constructed in this manner has no cracks through which dirt and debris may pass.

The vehicle weight applied to pedal 22 is of great magnitude. Therefore, as shown in FIGS. 13, the pedal 22 is designed to apply that pressure directly from the upper Z-bar flanges, which extend away from the center of the base, to the edges of vertical steel plates 240 and 242 set in the concrete base 220. These plates 240 and 242 support the Z-bars 222 and 224 along their entire length and will cut ice and trash to preserve that full length support. The upper flanges of the Z-bars 222 and 224 extend over the sloping concrete treads 244 and 246 so that dirt falling from the Z-bars will not fall under the pedal, but will instead spill down the outside inclines. Z-bar 222 and plates 228 and 230 are hingedly connected to plate 240 by hinge pins 248.

Referring to FIGS. 1, 12 and 13, the wooden lever 32 is pivotally attached to a post 26 at an end of the fence-like board barrier 24. The other end of the lever 32 is suspended on the chain 34 which extends to a lug 260 (FIG. 11) attached to member 100 and passes over the pulley 174. The rod 30 is pivotally secured to the end of the arm 232 of the pedal and extends upwards through a perforation in a bracket 262 (FIGS. 12 and 13) attached to lever 32. The upper end of this rod 30 is threaded and its effective length is adjustable by manipulating the double nuts 264 above the bracket.

In operation, when the pedal 22 is forced down from its normal slanted position shown in FIG. 1 to its seated position shown in FIG. 13, the chain 34 pulls longitudinal member 100 from its normal position shown in FIG. 3 to its shifted position shown in FIG. 10, releasing latch pin 40, whereupon the inner shell 106 shown in its blocked position in FIG. 10 will be pulled to the bridge bar 102 by the main spring 142, and the detent 122 carried by this inner shell 106 will fling the gate open. The block 204 then retains the bar 194 in its normal position and transmits the tension of the spring 208 against the plate 190 while on the opposite end of member 100 the spring bears against member 100 and increases in tension as the member 100 is thrust outward beyond its normal position, thereby raising the wooden lever and pedal on that side higher than normal. After the wheel has freed the pedal, the tension of the spring 208, being exerted on member 100 only on the outward thrust end, will draw member 100 back to its normal position and thereby also restore the pedals and wooden levers to their normal positions.

Preferably, by virtue of the linkage between the pedal 22 and the chain 34, depressing the pedal 22 one inch in its middle will result in a movement of about eight inches at the member 100. Inversely, the pressure required to depress the pedal 22 from its normal inclined position is about eight times the sum of friction and the tension of springs in unit 20, which springs hold the gate 10 closed and fling it open. The unit 20 can be protected by a shield attached to the board barrier. A bar may be extended from the ends of the barrier in front of the pedals when the gate is padlocked.

When the gate 10 swings from an open position to its closed position it comes to rest between both pairs of detents with an impact shock. The upper detents 120 and 122 are spaced a little closer together than the lower detents 70 and 72 so that an upper detent will receive the initial closing shock, transmit it to the shell 106 carrying the detent and thence to the main spring 142.

Although no new technology is needed in the construction of the gate 10, it is desirable to especially design this gate so that its intended operation succeeds under windy conditions. It is also desirable to choose a gate design that provides needed strength with reduced mass, for the mass and its distribution determine the burden imposed on the gate actuating mechanism and on the parts which receive the closing shock. In accordance with these considerations, it has been advantageous to make the gate frame of thin walled large diameter tubing and provide a barrier of barbed wires which livestock respect when spaced for reduced exposure of the gate to wind and icing.

Various means for holding gate 10 open for a predetermined interval and then closing the gate are known to the art. Such a means is described in my prior U.S. Pat. No. 4,378,657.

While certain embodiments of the present invention have been described in detail herein and shown in the accompanying Drawings, it will be evident that various further modifications are possible without departing from the scope of the invention.

I claim:

1. A pedal actuated gate comprising:

a gate mounted to pivot laterally between a normal closed position and open positions in two opposite directions from said closed position, said gate having an openable end;

an assembly mounted adjacent the openable end of the gate at its closed position;

said assembly having means for applying thrust in two lateral directions against said openable end of said gate to fling the gate to open positions in said two directions;

first and second pedal mechanisms engageable by a vehicle wheel, located one on each side of said gate and so connected with said means for applying thrust laterally to said gate that vehicle wheel engagement with a pedal mechanism actuates said assembly to fling the gate open in the direction away from said engaged pedal mechanism;

a pedal mounted on an elevated base and spanning an opening defined by said base;

said pedal being hinged at a hinge line near one side of said opening and having an arm extending beyond the distal end of said pedal from said hinge line;

said base having narrow edges along the side of said opening near said hinge line and along the thereto distal side of said opening for the pedal to rest on when depressed by wheel weight;

said pedal comprising extensions for resting on and extending beyond said edges;

said base sloping downward away from under said extensions of said pedal;

a lever pivotally mounted above said arm;

means connecting said arm and said lever; and means connecting said lever with said means for applying lateral pressure to said gate for flinging it to an open position.

2. An assembly for latching a gate closed and for flinging it to open positions in two directions, comprising:

an outer member mounted perpendicular to the gate in its normal closed position;

a pair of inner shells slidable longitudinally in said outer member;

said outer member having fixed partition means between said inner shells for maintaining each of said inner shells in a separate side of said outer member;

a spring stretched between the distal ends of said two inner shells and normally forcing said inner shells against said partition means;

a first pair of detents, one mounted on each of said inner shells, each adapted for receiving and confining gate structure adjacent thereto;

a second pair of detents, each adapted for latching said gate structure adjacent thereto and holding said gate in its normally closed position;

means for supporting said second pair of detents in fixed pivotal positions;

said outer member being movable longitudinally in both directions to a predetermined gate releasing position, whereby one of said inner shells is advanced by said partition means in the direction from said gate structure that said gate structure is to open, while the other inner shell is held back by confined gate structure latched between said second pair of detents, thereby elongating the spring and increasing its tensions;

means for retracting the detent of the first pair of detents which is advanced with the outer member before the outer member has advanced to said gate releasing position; and means for retracting the detent of said second pair of detents which is located in the direction from said gate structure that said gate structure is to open, when said outer shell reaches said predetermined gate releasing position, thereby releasing the gate to swing open with the energy applied by said spring.

3. An assembly according to claim 2 further comprising a latch bar normally projecting at the openable end of the gate, and said means for supporting said second pair of detents defining a channel for receiving the end portion of said latch bar and restricting it vertically for detent engagement.

4. The assembly according to claim 3 further comprising:

fixed upright supporting structure upon which said channel defining means is mounted and by which said outer shell is supported for longitudinal slidable movements; and said upright supporting structure being spaced apart a distance beyond the positions to which the outer shell is moved to retract said second pair of detents to release the latch bar for the gate's opening movement.

5. A pedal actuated gate wherein a laterally swinging hinged gate is flung from a normal closed position to a vehicle clearing open position by an opening mechanism actuated by a vehicle wheel, comprising:

a generally rectangular gate having an openable end;

a manually longitudinally retractable latch bar disposed upon said gate;

means for normally extending said latch bar outward at the openable end of said gate;

the opening mechanism including a guideway for said latch bar;

said guideway being mounted horizontally in a fixed position adjacent and perpendicular to the normal closed position of said gate;

said guideway restricting said latch bar vertically;

a pair of detents disposed adjacent said guideway for confining said latch bar laterally between them at the gate's normal closed position; and means for selectively moving either of said detents to release said latch bar for movement along said guideway in the direction of the moved detent and for simultaneously applying thrust laterally against said latch bar to fling the gate beyond said moved detent and said guideway to an open position for vehicle passage.

* * * * *